US008899160B2

(12) United States Patent
Haas et al.

(10) Patent No.: US 8,899,160 B2
(45) Date of Patent: Dec. 2, 2014

(54) ROLL COMPENSATION SYSTEM FOR RAIL VEHICLES

(75) Inventors: Herbert Haas, Graz (AT); Johannes Hirtenlechner, Graz (AT); Andreas Kienberger, Graz (AT); Johannes Müller, Graz (AT); Thomas Penz, Graz (AT); Helmut Ritter, Graz (AT); Martin Teichmann, Graz (AT); Herwig Waltensdorfer, Graz (AT); Tomas Ziskal, Graz (AT)

(73) Assignee: Siemens AG Oesterreich, Vienna (AT)

( * ) Notice: Subject to any disclaimer, the term of this patent is extended or adjusted under 35 U.S.C. 154(b) by 257 days.

(21) Appl. No.: 13/395,918

(22) PCT Filed: Sep. 6, 2010

(86) PCT No.: PCT/EP2010/063002
§ 371 (c)(1),
(2), (4) Date: Mar. 14, 2012

(87) PCT Pub. No.: WO2011/032850
PCT Pub. Date: Mar. 24, 2011

(65) Prior Publication Data

US 2012/0180693 A1 Jul. 19, 2012

(30) Foreign Application Priority Data

Sep. 15, 2009 (AT) ..... A 1459/2009

(51) Int. Cl.

| | |
|---|---|
| ***B61F 3/00*** | (2006.01) |
| ***B61F 5/00*** | (2006.01) |
| ***B61D 1/00*** | (2006.01) |
| ***B61F 5/22*** | (2006.01) |

(52) U.S. Cl.
CPC ..... *B61F 5/22* (2013.01)
USPC ..... 105/199.2; 105/164

(58) Field of Classification Search
CPC ..... B61F 5/00; B61F 5/06; B61F 5/08; B60G 17/00; B60G 17/016; B60G 17/0161; B60G 17/0162
USPC ..... 105/453, 164, 199.1, 199.2; 280/5.514; 267/218, 64.16
See application file for complete search history.

(56) References Cited

U.S. PATENT DOCUMENTS

| | | | | |
|---|---|---|---|---|
| 3,580,557 | A | 5/1971 | Dean | |
| 3,614,931 | A | 10/1971 | Adler | |
| 5,401,053 | A | 3/1995 | Sahm et al. | |
| 5,539,639 | A * | 7/1996 | Devaud et al. | 701/37 |

FOREIGN PATENT DOCUMENTS

| | | | |
|---|---|---|---|
| CN | 1005762 | B | 11/1989 |
| DE | 1916404 | A1 | 10/1970 |
| DE | 4231641 | A1 | 3/1994 |
| DE | 19609032 | A1 | 9/1997 |
| DE | 19653529 | C1 | 2/1998 |
| DE | 20321079 | U1 | 6/2006 |
| EP | 0619212 | A1 | 10/1994 |
| FR | 2695875 | A1 | 3/1994 |

(Continued)

*Primary Examiner* — R. J. McCarry, Jr.
(74) *Attorney, Agent, or Firm* — Laurence A. Greenberg; Werner H. Stemer; Ralph E. Locher

(57) ABSTRACT

A rocking compensation system for rail vehicles includes actuators which are arranged within primary helical compression springs of bogies for a targeted height adjustment of a bogie frame of the bogie.

5 Claims, 10 Drawing Sheets

(56) References Cited

FOREIGN PATENT DOCUMENTS

| | | | |
|---|---|---|---|
| GB | 574817 | A | 1/1946 |
| JP | 11129900 | A | 5/1999 |
| WO | WO 03051656 | A1 | 6/2003 |

* cited by examiner

ROLL COMPENSATION SYSTEM FOR RAIL VEHICLES

CROSS REFERENCE TO RELATED APPLICATIONS

This application is the US National Stage of International Application No. PCT/EP2010/063002 filed Sep. 6, 2010, and claims the benefit thereof. The International Application claims the benefits of Austrian Application No. A1459/2009 AT filed Sep. 15, 2009. All of the applications are incorporated by reference herein in their entirety.

FIELD OF INVENTION

The invention relates to a roll compensation system for rail vehicles.

BACKGROUND OF INVENTION

When a rail vehicle travels through a curve, the centrifugal force produces a moment whereby the car tilts towards the outside of the curve. As a result of this tilting, the system of coordinates also rotates for the passenger situated in the car body, and part of the gravitational acceleration now acts as lateral acceleration, which is perceived as particularly disagreeable.

Particularly in the case of rapid travel through curves with high transverse acceleration at the wheelset, permissible values for the passenger are clearly exceeded in the absence of additional measures.

So-called tilting technology comprising curve-dependent car body control is known from the prior art, and allows the car bodies of a railway train to be tilted towards the inside of the curve and therefore reduce the perceived lateral acceleration.

It is thus possible to travel through curves faster or increase passenger comfort when travelling though curves (comfort tilting).

Tilting technology systems disclosed in the prior art, e.g. as described in EP 0619212, allow curve tilting up to 8°. The speed in curves can therefore be increased by up to 30% without thereby adversely affecting passenger comfort due to increased lateral acceleration.

A disadvantage of the known tilting technology systems is their comparatively high design costs, also resulting in high costs in terms of manufacturing, power requirements, sensor technology and maintenance.

SUMMARY OF INVENTION

The claimed invention addresses the problem of improving the known methods.

This problem is solved by a roll compensation system as claimed in the independent claim.

Advantageous embodiments of the roll compensation system are derived from the dependent claims.

The claimed invention is explained in greater detail with reference to schematic figures of exemplary nature.

DETAILED DESCRIPTION OF INVENTION

Figure 1:
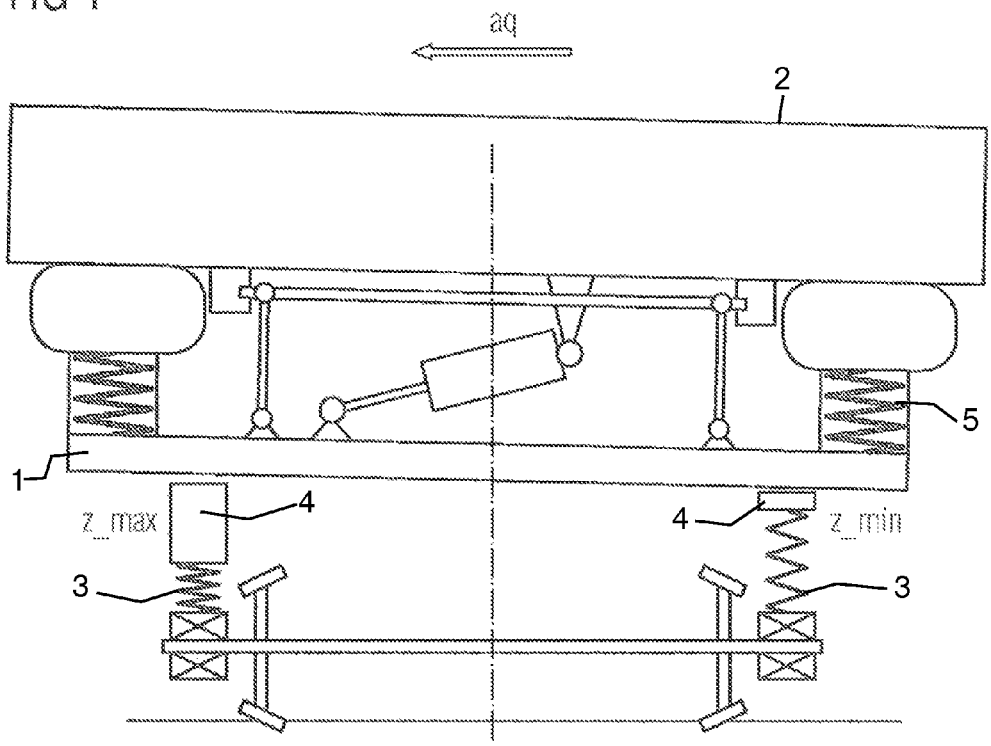
FIG. 1 shows the basic design of a roll compensation system according to the claimed invention.

The illustration according to FIG. 1 shows a roll compensation system comprising a height adjustment of the bogie frame 1 by means of hydraulic cylinders, which are arranged within the primary helical compression springs 3 and are continuously raised against gravity on the outside of the curve and lowered on the inside of the curve.

This functionality advantageously causes an increase in the effect of the difference in height of rails in the curve, and therefore the travel time of a rail vehicle on the corresponding line section can be shortened by increasing the travel speed in the curve without having to modify the layout of the line.

The height adjustment not only compensates for but deliberately overcompensates for the roll angle that is produced by the spring stiffnesses in primary and secondary spring stages 3,5, and therefore keeps the maximal transverse acceleration on the passenger within the required range.

When a defined threshold value of the transverse acceleration is reached, the control unit initiates a raising/lowering of the bogie frame 1 by a value that is predetermined by the control unit/regulator.

This already occurs during travel in the transition curve, such that the final setting has already been assumed when the curve with constant radius is reached, and the quasi-static transverse acceleration remains constant during travel through the curve (without further control/regulation).

The inventive design offers advantages over known solutions in a number of respects.

In terms of running, the running technology can be optimized in a customary manner because knowledge relating to existing vehicles can be transferred to the inventive design. The vehicle approvals procedure can also be transferred from existing vehicles.

Concerning the vehicle width, there are no design limitations which affect existing designs in the R series.

A simple upgrade or partial refit of existing vehicles is possible, since the construction space is provided for this in the basic design.

In the event of a hydraulic failure (zero-current, electric motor failure, etc.) the vehicle will again assume the state of least potential energy by virtue of its own weight, and can be operated in this state in the R series.

Figure 2A:
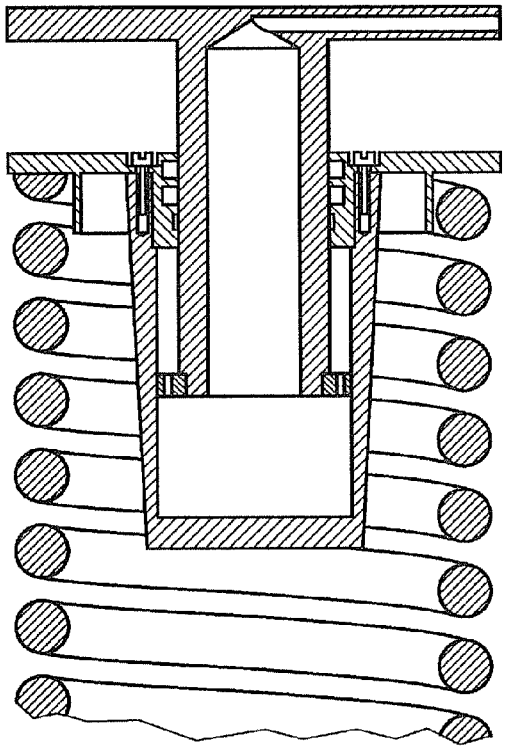
FIGS. 2*a* and 2*b* show a sectional view of the primary springs comprising integrated hydraulic cylinders.
Figure 2B:
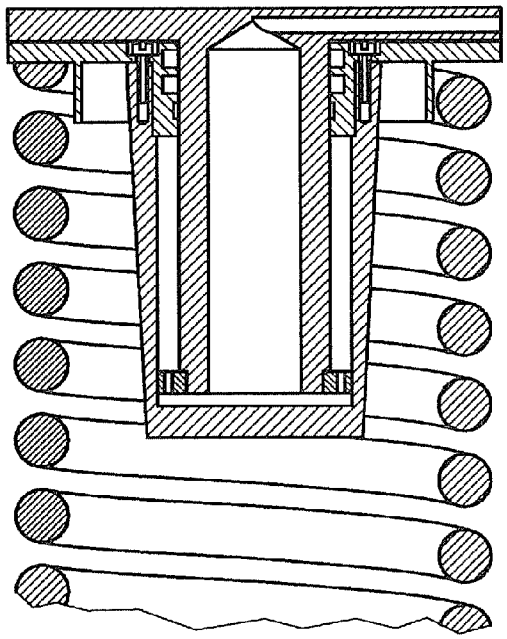

The illustrations according to FIGS. 2*a* and 2*b* show sectional views of the primary springs 3 comprising integrated hydraulic cylinders in accordance with the invention. FIG. 2*a* shows the case of an extended hydraulic cylinder 6 and FIG. 2*b* shows the case of a retracted hydraulic cylinder 6.

Figure 3:
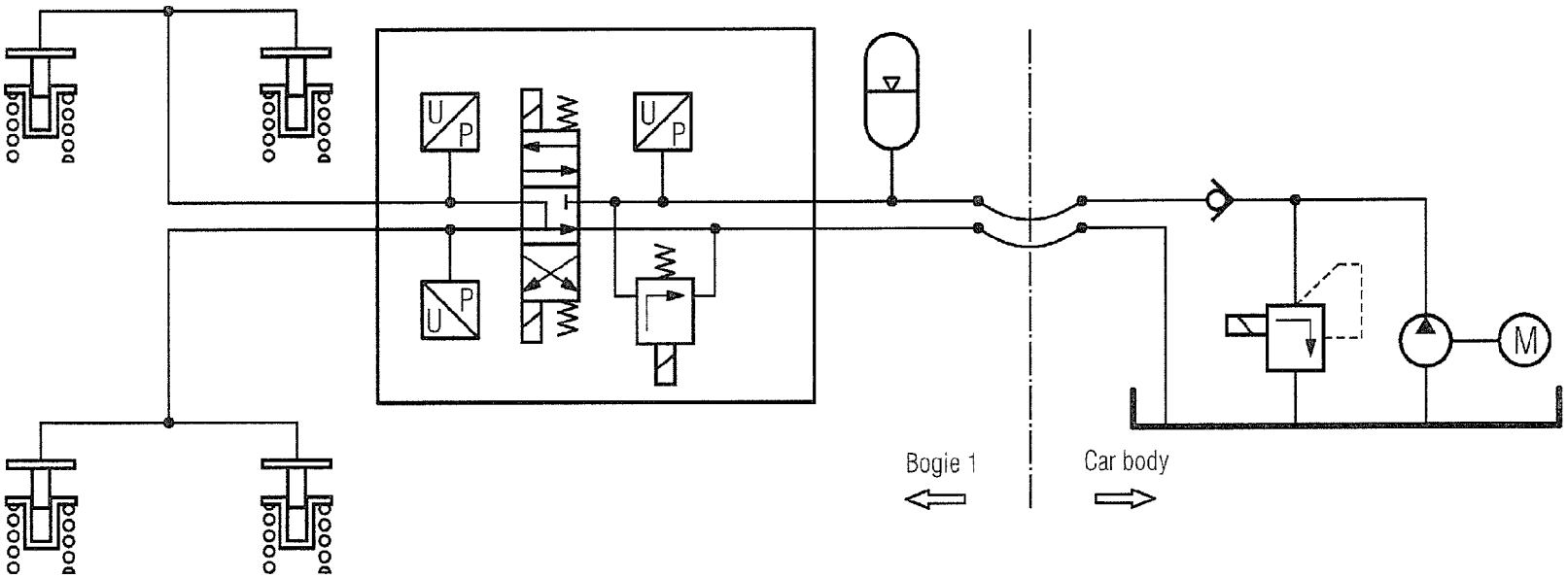
FIG. 3 schematically shows a hydraulic circuit diagram in a first embodiment, the so-called "default setting down variant"

Different conceivable embodiments of the invention are explained in greater detail with reference to the further figures. These embodiments differ in particular by virtue of the position of the car body 2 in the default setting. FIG. 3 schematically shows a hydraulic circuit diagram in a first embodiment, the so-called "default setting down variant".

All descriptions and performance data relate to a bogie. The decision whether certain components (e.g. oil container and pump) should be embodied centrally for each car body 2 or for each bogie is made during the project implementation.

This first embodiment advantageously requires no displacement sensors; the positional displacement of the serial hydraulic cylinders 6 is mechanically defined by permanent stops and is achieved purely by pressurization and monitored by means of pressure sensors.

The everyday operation is defined by the following functionality:

1) Zero-current state: all valves (DRV, displacement valve, discharge valve) are fully open, the system including high-pressure store is pressureless. The car body 2 has its lowest (fail safe) setting.

2) In the presence of current and an electrical signal from the control unit, the pressure discharge valve and the DRV close, the motor turns and the pump delivers a constant volume flow and pumps up the high-pressure store to its nominal pressure (p=350 bar).

3) The pressure sensor detects the fully charged high-pressure store and the control unit opens the DRV, whereby the pressure in the supply line to the store drops to 0 bar (energy saving) and the RV prevents a discharge of the store into the tank. The system is ready for use.

4) During travel through a curve, the control unit (gyroscope+transverse acceleration) detects which side of the bogie frame 1 must be raised, and switches the displacement valve to the corresponding side. Both hydraulic cylinders 6 of a bogie side extend as far as the stop in approximately 2 seconds and remain in this setting throughout the travel through the curve. The opposite side remains pressureless (connected to the oil container).

5) The high-pressure store releases approximately 0.7 liters of oil in this case, whereby the pressure drops from 350 bar to 250 bar. The control unit detects this via the pressure sensor and closes the DRV again, whereby the pressure in the line increases and the pump replenishes the high-pressure store via the RV. The system design ensures that said high-pressure store is charged again before the next curve is reached.

6) Completion of the curve is detected by the control unit (gyroscope+transverse acceleration), which cancels the control signal from the displacement valve, whereby the valve assumes its midway setting (established by springs) and the raised side moves downwards to the default setting.

7) Continuation of travel as usual from point 4).

8) At the end of the daily operation, the pressure discharge valve ensures that, with zero-current in the vehicle, the hydraulic system including all components is pressureless and can be safely turned off and/or maintained.

Figure 4:
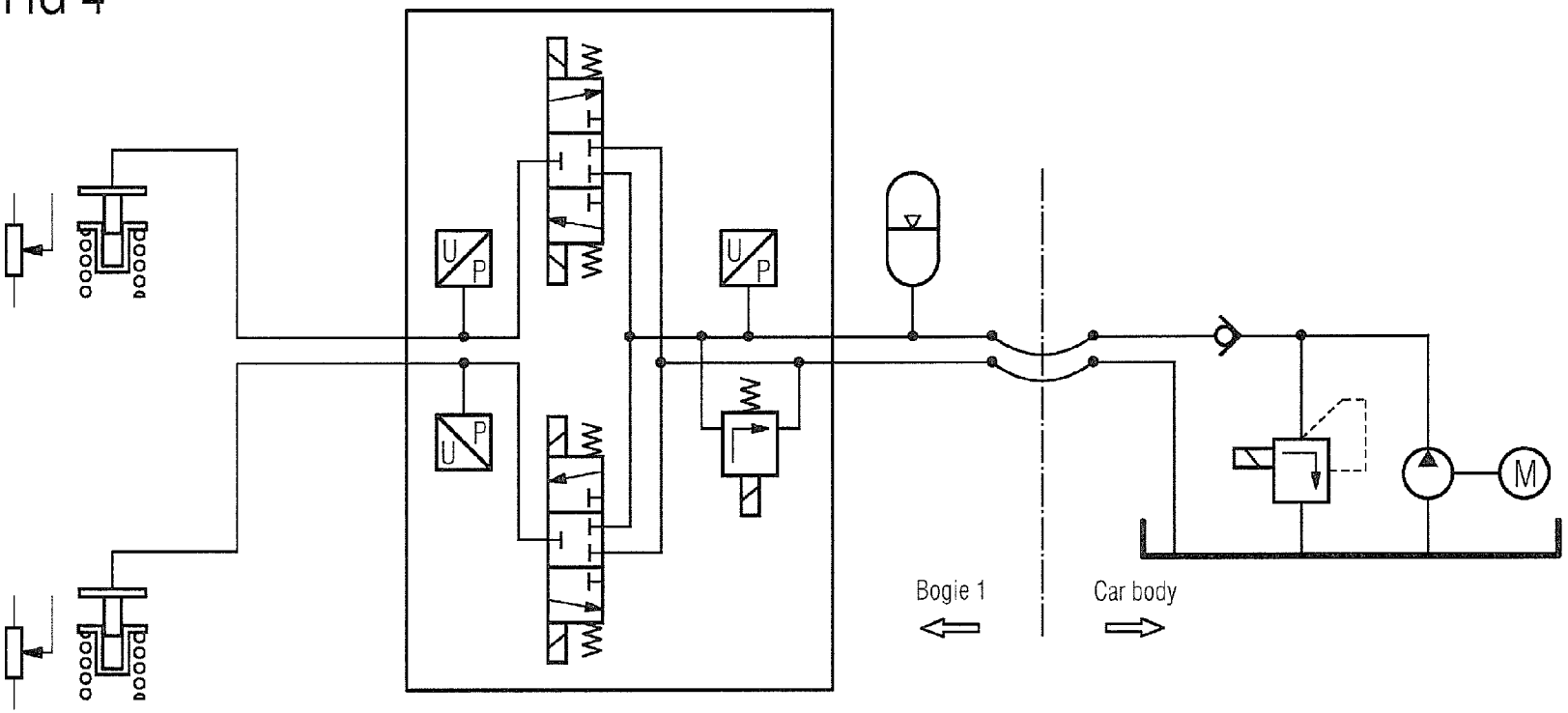
FIG. 4 shows a hydraulic circuit diagram in a second embodiment, the so-called "default setting midway variant with displacement measurement system"

FIG. 4 schematically shows a hydraulic circuit diagram in a second embodiment, the so-called "default setting midway variant with displacement measurement system".

This embodiment advantageously allows the geometry of the swing guide to be used for the radial adjustment of the wheelset, thereby minimizing the wheel wear.

Figure 4A:
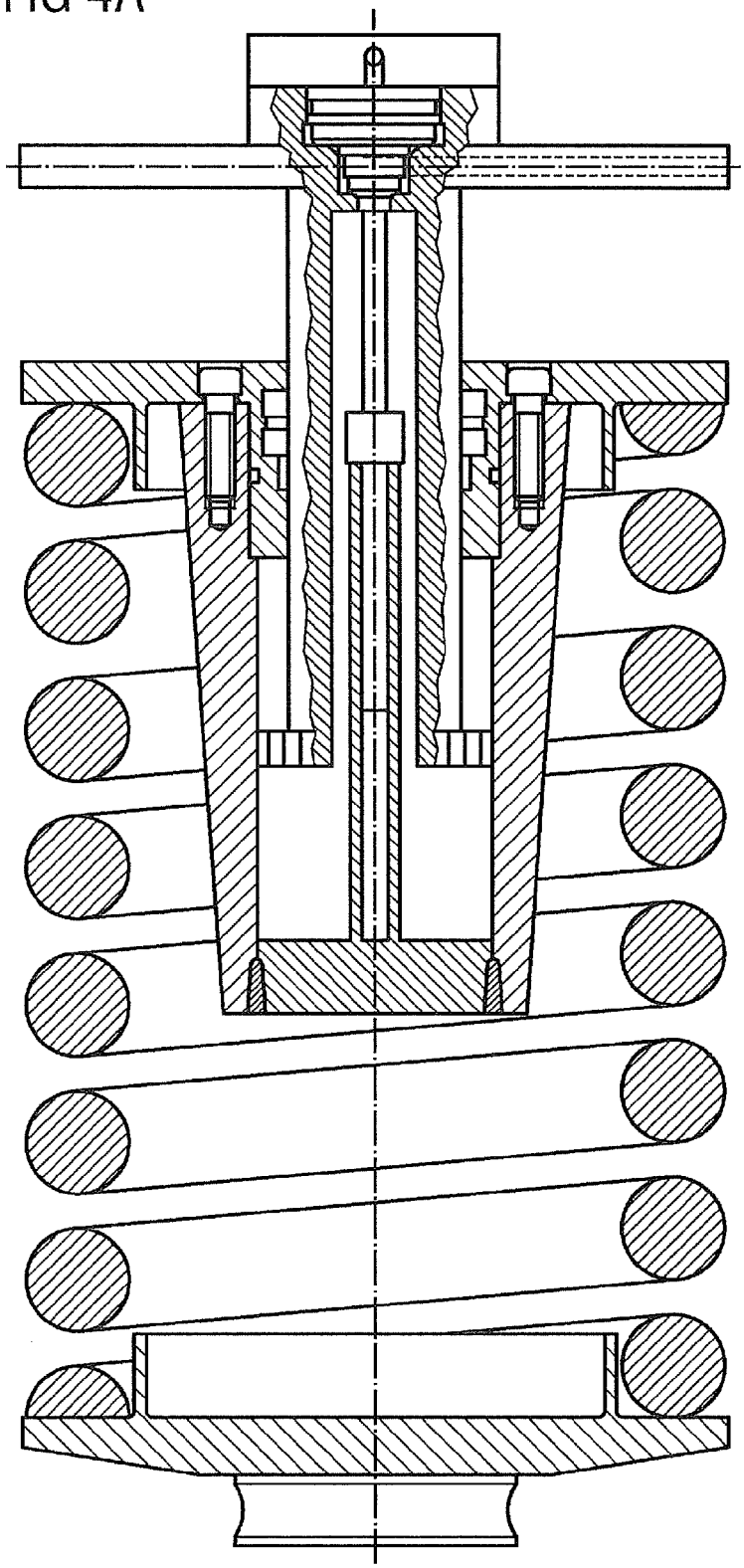
FIG. 4*a* shows the integration of a displacement measurement system in an actuator.

As illustrated in FIG. 4*a*, the actuator is arranged in series with the primary spring 3, and the displacement measurement system (4 per bogie) is protectively housed in the actuator (measures the actuator displacement without the spring displacement of the primary spring 3).

The everyday operation is defined by the following functionalities:

1) Zero-current state: all valves (DRV, displacement valve, discharge valve) are fully open, the system including high-pressure store is pressureless. The car body 2 has its lowest (fail safe) setting.

2) In the presence of current and an electrical signal from the control unit, the pressure discharge valve and the DRV close, the motor turns and the pump delivers a constant volume flow and pumps up the high-pressure store to its nominal pressure (p=350 bar).

3) The pressure sensor detects the fully charged high-pressure store and the control unit opens the DRV, whereby the pressure in the supply line to the store drops to 0 bar (energy saving) and the RV prevents a discharge of the store into the tank.

4) The displacement sensors (2 per bogie side) in the primary stage detect the current height, and the control unit causes the height-regulating valves to lift the bogie frame up to a defined height (but not as far as the stop) in the default setting. The system is ready for use.

5) During travel through a curve, the control unit (gyroscope+transverse acceleration) detects which side of the bogie frame 1 must be raised and which side must be lowered, and switches the displacement valves to the corresponding settings. Both hydraulic cylinders of a bogie side extend or retract as far as the stop in approximately 2 seconds and remain in this setting throughout the travel through the curve.

6) The high-pressure store releases approximately 0.35 liters of oil in this case, whereby the pressure drops from 350 bar to 300 bar.

7) Completion of the curve is detected by the control unit (gyroscope+transverse acceleration), and the height-regulating valves return to the default setting. The oil requirement for the adjustment is again approximately 0.35 liters of oil and the pressure in the high-pressure store drops from 300 bar to 250 bar.

8) The control unit detects the reduced pressure level in the high-pressure store via the pressure sensor and closes the DRV again, whereby the pressure in the line increases and the pump replenishes the high-pressure store via the RV. The system design ensures that said high-pressure store is charged again before the next curve is reached.

9) Continuation of travel as usual from point 4)

10) At the end of the daily operation, the pressure discharge valve ensures that, with zero-current in the vehicle, the hydraulic system including all components is pressureless and can be safely turned off and/or maintained.

Figure 5:
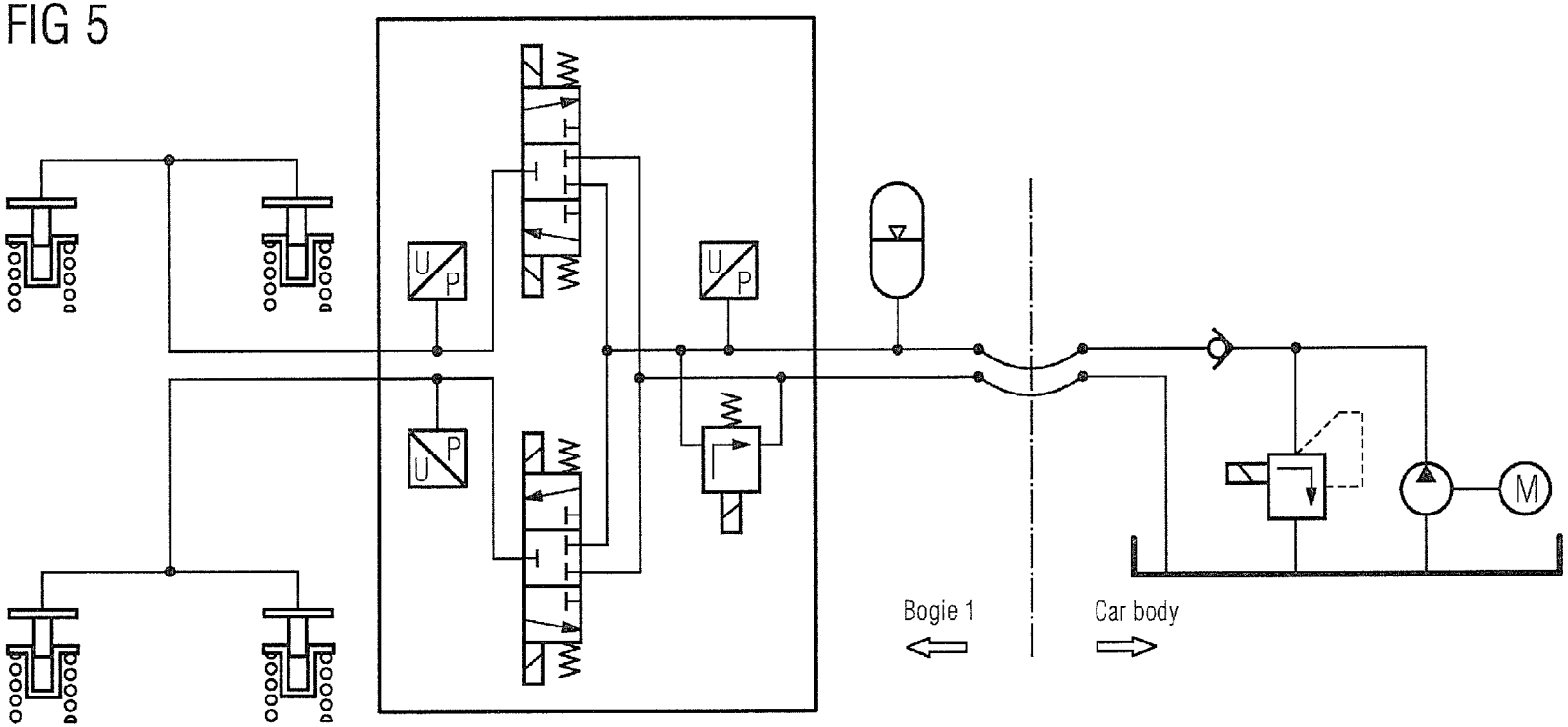
FIG. 5 shows a hydraulic circuit diagram in a third embodiment, the so-called "default setting midway variant with auxiliary piston"
Figure 5A:
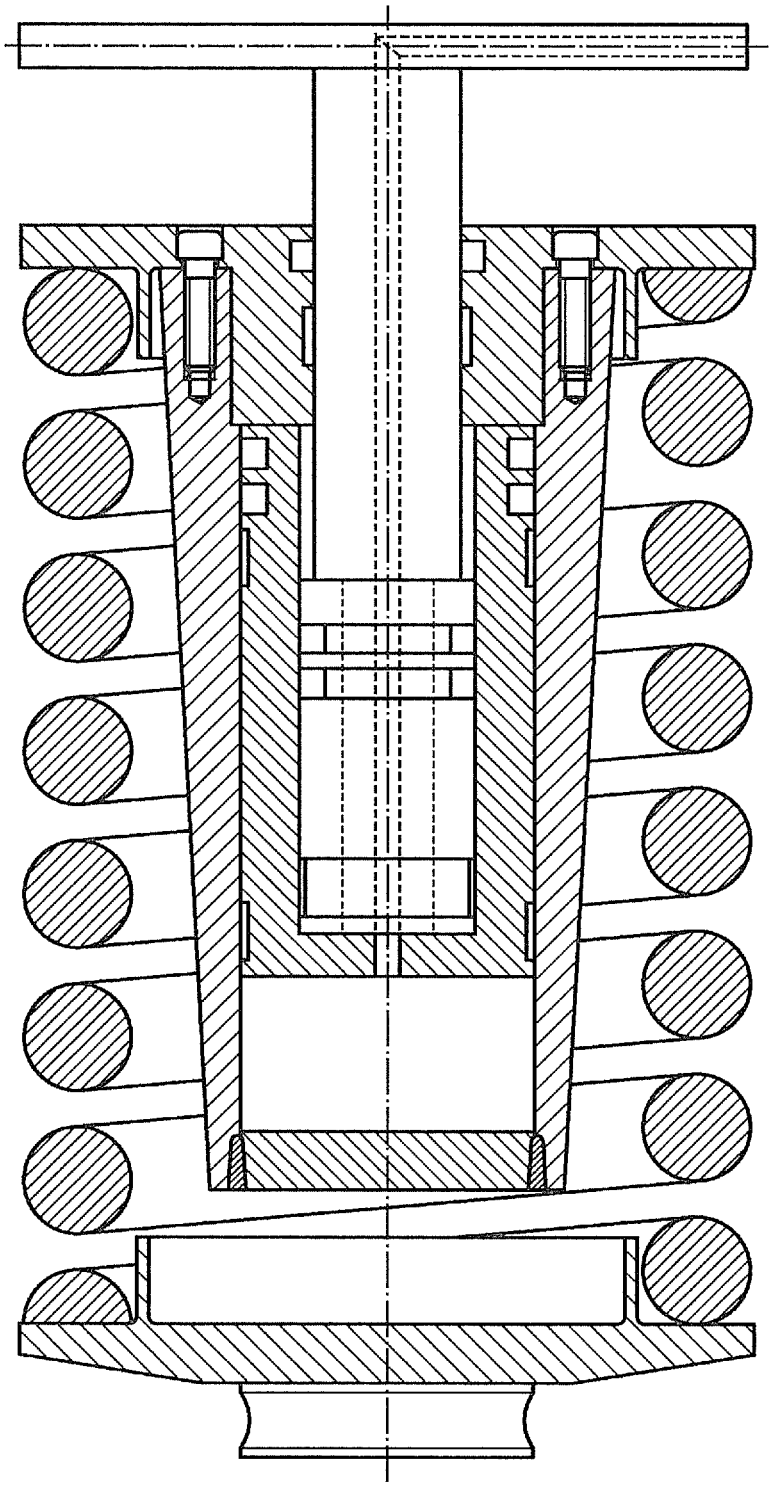
FIG. 5*a* shows the structure of an actuator comprising an auxiliary piston.

FIG. 5 schematically shows a hydraulic circuit diagram in a third embodiment, the so-called "default setting midway variant with auxiliary piston". The structural layout of the actuator with auxiliary piston is shown in FIG. 5*a*.

This embodiment advantageously allows the geometry of the swing guide to be used for the radial adjustment of the wheelset, thereby minimizing the wheel wear.

However, the adjustment of the default setting does not require displacement sensors, and instead the height is established by means of a telescopic actuator and a suitable choice of the piston surfaces (of main and auxiliary pistons) and control pressure. As a result of the larger surface of the auxiliary piston, the oil requirement and hence the high-pressure store are also larger.

ABBREVIATIONS p0 pressureless for fully retracted cylinder (0 bar)

p1 control pressure for midway setting (approximately 80 bar)

p2 maximum pressure for fully extended actuator (approximately 250 bar)

Aw effective surface of the main piston (Dw=approximately 60 mm)

Ah effective surface of the auxiliary piston (Dh=approximately 100 mm)

The relationship between the pressures and the piston surfaces is determined by the following conditions:

The pressure p1 on the effective surface of the auxiliary piston must be able to lift the fully laden vehicle including dynamic forces (p1*Ah>Fz_max).

The pressure p1 on the effective surface of the main piston must not be able to lift the empty vehicle including dynamic rebound (p1*Aw<Fz_min).

The pressure p2 on the effective surface of the main piston must be able to lift the fully laden vehicle including dynamic forces (p2*Aw>Fz_max).

The functionality in daily operation is as follows:

1) Zero-current state: all valves (DRV, displacement valve, discharge valve) are fully open, the system including high-pressure store is pressureless. The car body has its lowest (fail safe) setting.

2) In the presence of current and an electrical signal from the control unit, the pressure discharge valve and the DRV close, the motor turns and the pump delivers a constant volume flow and pumps up the high-pressure store to its nominal pressure (p=350 bar).

3) The pressure sensor detects the fully charged high-pressure store and the control unit opens the DRV, whereby the pressure in the supply line to the store drops to 0 bar (energy saving) and the RV prevents a discharge of the store into the tank.

4) The pressure p1 is required for the midway setting and the two valves open in order to lift both sides of the bogie frame.

5) The pressure sensors in the primary stage detect when p1 (approximately 80 bar) is reached and close the valves. The defined height (stop of the auxiliary piston) in the default setting is reached. The system is ready for use.

6) During travel through a curve, the control unit (gyroscope+transverse acceleration) detects which side of the bogie frame must be raised (control pressure p2=approximately 250 bar) and which side must be lowered (control pressure p0=0 bar), and switches the displacement valves to the corresponding positions. Both hydraulic cylinders of a bogie side extend or retract as far as the stop in approximately 2 seconds and remain in this setting throughout the travel through the curve. The final settings are unambiguously determined (and can be monitored) by the pressures (p0=stop at bottom, p2=stop at top).

7) The high-pressure store releases approximately 0.35 liters of oil in this case (lifting to Aw), whereby the pressure drops from 350 bar to 320 bar.

8) Completion of the curve is detected by the control unit (gyroscope+transverse acceleration), and valves switch back to p1 in order to return to the default setting. This time the oil requirement for the adjustment is approximately 1.0 liters of oil (lifting to Ah) and the pressure in the high-pressure store drops from 320 bar to 250 bar.

9) The control unit detects the reduced pressure level in the high-pressure store via the pressure sensor and closes the DRV again, whereby the pressure in the line increases and the pump replenishes the high-pressure store via the RV. The system design ensures that said high-pressure store is charged again before next curve is reached.

10) Continuation of travel as usual from point 6)

11) At the end of the daily operation, the pressure discharge valve ensures that, with zero-current in the vehicle, the hydraulic system including all components is pressureless and can be safely turned off and/or maintained.

Figure 6:
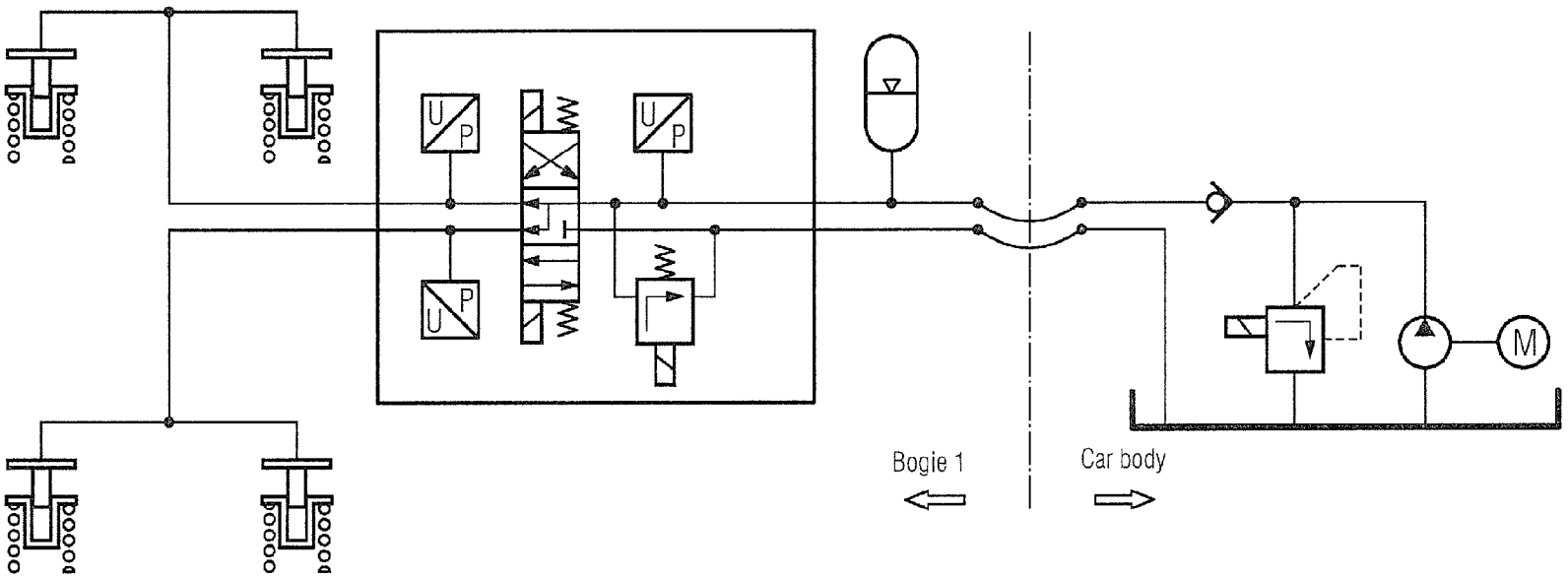
FIG. 6 shows a hydraulic circuit diagram in a fourth embodiment, the so-called "default setting up variant"

FIG. 6 schematically shows a hydraulic circuit diagram in a fourth embodiment, the so-called "default setting up variant".

This embodiment has the advantage in particular of requiring no displacement sensors, since the positional displacement of the serial hydraulic cylinders is mechanically defined by permanent stops and is achieved purely by pressurization and monitored by means of pressure sensors. Radial adjustment of the wheelset by means of the swing effect is possible, but this advantage is lost again if the system fails.

Daily operation:

1) Zero-current state: all valves (DRV, displacement valve, discharge valve) are fully open, the system including high-pressure store is pressureless. The car body 2 has its lowest (fail safe) setting.

2) In the presence of current and an electrical signal from the control unit, the pressure discharge valve and the DRV close, the motor turns and the pump delivers a constant volume flow and pumps up the high-pressure store to its nominal pressure (p=350 bar).

3) The pressure sensor detects the fully charged high-pressure store and the control unit opens the DRV, whereby the pressure in the supply line to the store drops to 0 bar (energy saving) and the RV prevents a discharge of the store into the tank.

4) The valve switches pressure to both sides and all 4 actuators lift the bogie frame 1 as far as the stop. The system is ready for use.

5) During travel through a curve, the control unit (gyroscope+transverse acceleration) detects which side of the bogie frame 1 (inside of the curve) must be lowered,and switches the displacement valve to the corresponding side. Both hydraulic cylinders of a bogie side travel downwards as far as the stop in approximately 2 seconds and remain in this setting throughout the travel through the curve. The opposite side remains pressurized (connected to the high-pressure store).

6) Completion of the curve is detected by the control unit (gyroscope+transverse acceleration), which cancels the control signal from the displacement valve, whereby the valve assumes its midway setting (established by springs) and the lowered side is raised again.

7) The high-pressure store releases approximately 0.7 liters of oil in this case, whereby the pressure drops from 350 bar to 250 bar. The control unit detects this via the pressure sensor and closes the DRV again, whereby the pressure in the line increases and the pump replenishes the high-pressure store via the RV. The system design ensures that said high-pressure store is charged again before the next curve is reached.

8) Continuation of travel as usual from point 5)

9) At the end of the daily operation, the pressure discharge valve ensures that, with zero-current in the vehicle, the hydraulic system including all components is pressureless and can be safely turned off and/or maintained.

Figure 7:
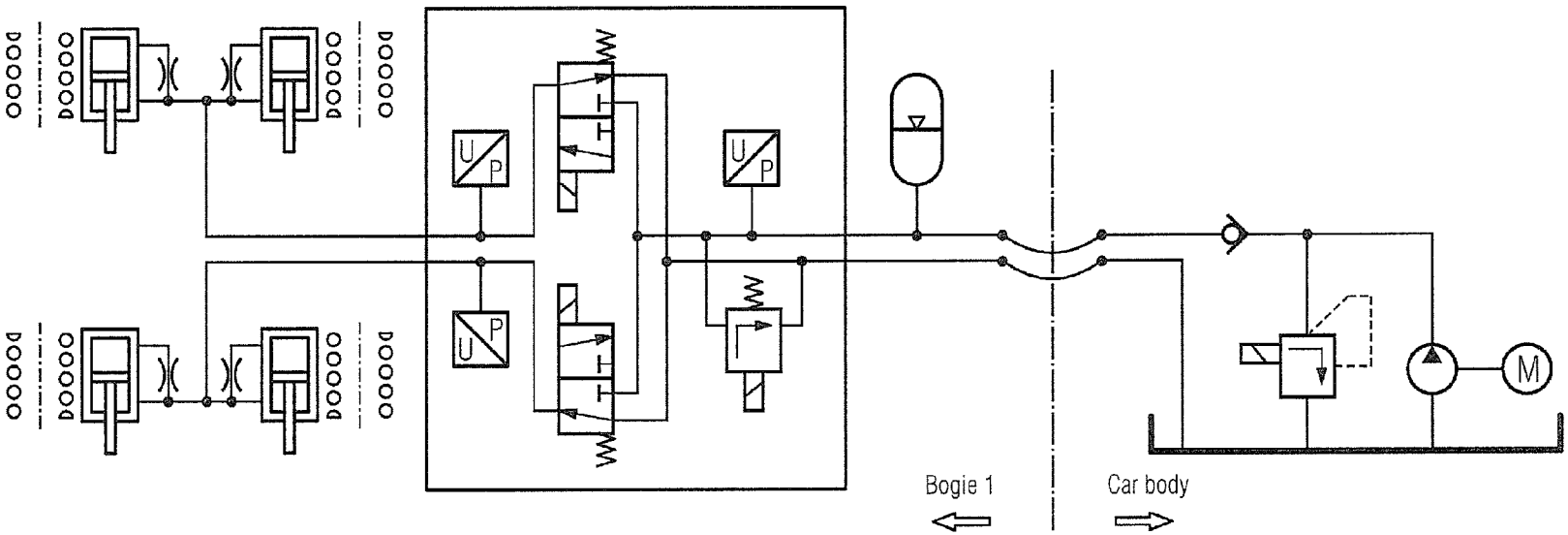
FIG. 7 shows a hydraulic circuit diagram in a fifth embodiment, the so-called "parallel actuator variant"

FIG. 7 schematically shows a hydraulic circuit diagram in a fifth embodiment, the so-called "parallel actuator variant", in which the actuator force acts in parallel with the primary suspension.

This variant has the advantages of the "default setting midway" embodiment, but the displacement measurement system can be omitted here because the characteristic curve of the primary spring 3 itself is used as a relationship between pressure in the actuator and displacement in the spring stage.

The actuator can simultaneously perform the function of a hydraulic damper.

Daily operation:

1) Zero-current state: all valves (DRV, displacement valve, discharge valve) are fully open, the system including high-pressure store is pressureless. The car body has its lowest (fail safe) setting.

2) In the presence of current and an electrical signal from the control unit, the pressure discharge valve and the DRV close, the motor turns and the pump delivers a constant volume flow and pumps up the high-pressure store to its nominal pressure (p=350 bar).

3) The pressure sensor detects the fully charged high-pressure store and the control unit opens the DRV, whereby the pressure in the supply line to the store drops to 0 bar (energy saving) and the RV prevents a discharge of the store into the tank.

4) The actuator acts as a passive damper during travel on the straight track sections.

5) During travel through a curve, the control unit (gyroscope+transverse acceleration) detects which side of the bogie frame 2 must be raised and which side must be lowered, and causes the pressure valves to apply the calculated control pressure to the actuators 4 acting on both sides (can transfer tractive and compressive forces). The height is adjusted upwards or downwards for each bogie side due to the characteristics of the primary stage, and the bogie frame 1 is tilted.

6) The actuators 4 ensure that the pressure remains constant during the travel through the curve, but the suspension performs dynamic spring displacements and the actuators 4 have to follow these spring displacements without introducing additional stiffnesses into the primary spring. The hydraulic supply and a high-pressure store provide the oil that is required for this purpose.

7) Completion of the curve is detected by the control unit (gyroscope+transverse acceleration), which cancels the control signal from the pressure valves and the bogie frame 1 returns to its original position.

8) The control unit detects the reduced pressure level in the high-pressure store via the pressure sensor and closes the DRV again, whereby the pressure in the line increases and the pump replenishes the high-pressure store via the RV. The system design ensures that said high-pressure store is charged again before the next curve is reached.

9) Continuation of travel as usual from point 4).

10) At the end of the daily operation, the pressure discharge valve ensures that, with zero-current in the vehicle, the hydraulic system including all components is pressureless and can be safely turned off and/or maintained.

Figure 8:
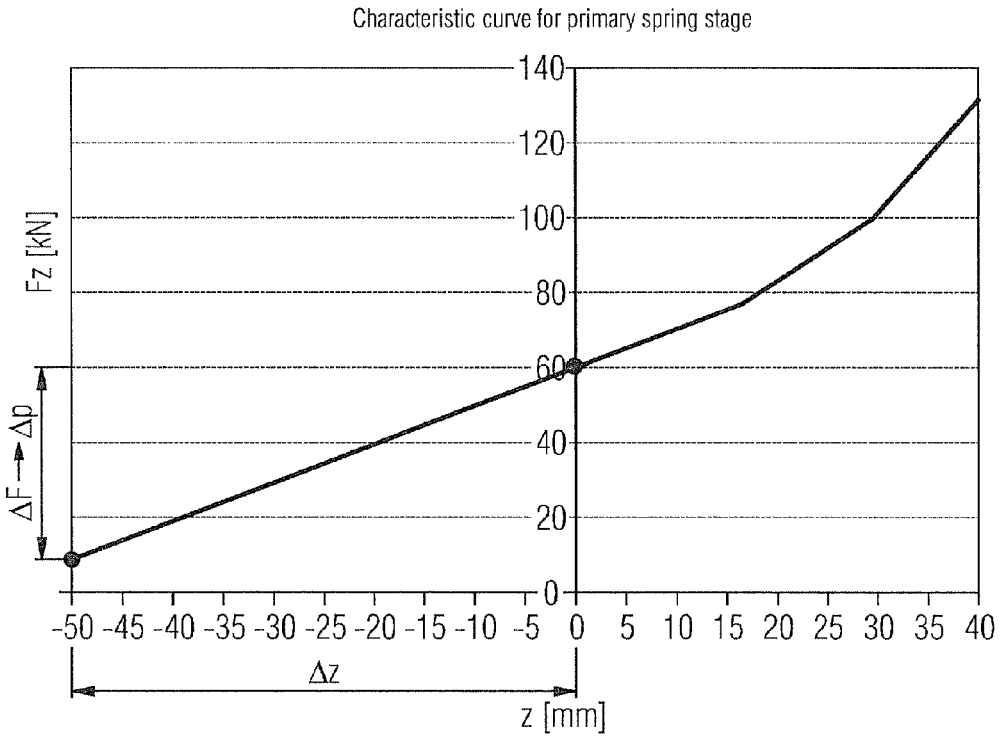
FIG. 8 shows the relationship between pressure and primary spring displacement.

FIG. 8 schematically shows a hydraulic circuit diagram in a sixth embodiment, the so-called "pin-guide actuator variant".

The invention claimed is:

1. A roll compensation system for rail vehicles, having a car body, a wheel axle and a bogie with a bogie frame, the roll compensation system comprising:

a primary helical spring stage with primary compression springs;

a secondary spring stage with secondary compression springs;

said secondary spring stage disposed between the bogie and the car body; and actuators disposed between the wheel axle and the bogie frame and within said primary helical compression springs for a targeted height adjustment of the bogie frame.

2. The roll compensation system as claimed in claim 1, wherein operating modes are assigned to a moving vehicle, and a predetermined control of the bogie frame by the actuators is assigned to each operating mode.

3. The roll compensation system as claimed in claim 2, wherein the operating modes include "straight ahead", "curve to left" and "curve to right", and wherein a one-sided height adjustment of the bogie frame occurs in the operating modes "curve to left" and "curve to right".

4. The roll compensation system as claimed in claim 3, wherein the predetermined height adjustment compensates for a tilt angle of approximately 3 degrees.

5. The roll compensation system as claimed in claim 1, wherein the actuators are hydraulic cylinders.

* * * * *

UNITED STATES PATENT AND TRADEMARK OFFICE

CERTIFICATE OF CORRECTION

PATENT NO. : 8,899,160 B2
APPLICATION NO. : 13/395918
DATED : December 2, 2014
INVENTOR(S) : Herbert Haas et al.

It is certified that error appears in the above-identified patent and that said Letters Patent is hereby corrected as shown below:

In the Claims

Claim 1

Col. 8, Lines 18 and 19, should read:

a primary spring stage with primary helical compression springs;

Signed and Sealed this
Tenth Day of March, 2015

Michelle K. Lee

Michelle K. Lee
*Deputy Director of the United States Patent and Trademark Office*